US007861521B2

(12) United States Patent
Zhang et al.

(10) Patent No.: US 7,861,521 B2
(45) Date of Patent: Jan. 4, 2011

(54) METHOD FOR REGENERATING A DIESEL PARTICULATE FILTER

(75) Inventors: Wenzhong Zhang, Savage, MN (US); Theodore G. Angelo, St. Paul, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 135 days.

(21) Appl. No.: 12/370,411

(22) Filed: Feb. 12, 2009

(65) Prior Publication Data

US 2009/0235649 A1 Sep. 24, 2009

Related U.S. Application Data

(63) Continuation of application No. 11/284,143, filed on Nov. 21, 2005, now abandoned.

(60) Provisional application No. 60/674,943, filed on Apr. 26, 2005.

(51) Int. Cl.
*F01N 3/00* (2006.01)

(52) U.S. Cl. ..... 60/286; 60/274; 60/295; 60/297; 60/301; 60/303

(58) Field of Classification Search ..... 60/274, 60/286, 295, 297, 301, 303
See application file for complete search history.

(56) References Cited

U.S. PATENT DOCUMENTS 4,372,111 A 2/1983 Virk et al.
4,416,674 A 11/1983 McMahon et al.
4,449,362 A 5/1984 Frankenberg et al.
4,652,286 A 3/1987 Kusuda et al.
4,686,827 A 8/1987 Wade et al.
4,902,487 A 2/1990 Cooper et al.
5,157,007 A 10/1992 Domesle et al.
5,207,990 A 5/1993 Sekiya et al.
5,522,218 A 6/1996 Lane et al.

(Continued)

FOREIGN PATENT DOCUMENTS

FR 2 860 837 A1 4/2005

(Continued)

OTHER PUBLICATIONS

"California enforcing $NO_2$ limits for diesel emission retrofits," http://www.dieselnet.com/news/2006/11arb.php, 1 page (Nov. 6, 2006).

(Continued)

*Primary Examiner*—Binh Q Tran
(74) *Attorney, Agent, or Firm*—Merchant & Gould P.C.

(57) ABSTRACT

A method is disclosed for regenerating a diesel particulate filter without excessively increasing $NO_2$ emissions. The system includes a fuel delivery device, an oxidation catalyst, and a diesel particulate filter. During a first operational mode, the fuel injection device injects a relatively smaller amount of fuel into the exhaust stream to reduce the capacity of the oxidation catalyst to oxidize NO in the exhaust stream to $NO_2$. At a determined time, a second operational mode is initiated where a relatively larger amount of fuel is injected into the exhaust stream and is oxidized within the oxidation catalyst, thereby raising the exhaust temperature sufficiently to combust substantially all of the soot trapped on the diesel particulate filter.

22 Claims, 2 Drawing Sheets

U.S. PATENT DOCUMENTS

| | | | | |
|---|---|---|---|---|
| 5,746,989 | A | 5/1998 | Murachi et al. | |
| 5,996,337 | A | 12/1999 | Blosser et al. | |
| 6,023,930 | A | 2/2000 | Abe et al. | |
| 6,032,461 | A * | 3/2000 | Kinugasa et al. | 60/295 |
| 6,119,448 | A | 9/2000 | Emmerling et al. | |
| 6,199,375 | B1 | 3/2001 | Russell | |
| 6,293,096 | B1 | 9/2001 | Khair et al. | |
| 6,294,141 | B1 | 9/2001 | Twigg et al. | |
| 6,484,495 | B2 | 11/2002 | Minami | |
| 6,534,021 | B1 | 3/2003 | Maus | |
| 6,546,721 | B2 | 4/2003 | Hirota et al. | |
| 6,582,490 | B2 | 6/2003 | Miller et al. | |
| 6,669,913 | B1 | 12/2003 | Haberkamp | |
| 6,673,136 | B2 | 1/2004 | Gillingham et al. | |
| 6,742,331 | B2 | 6/2004 | Minami | |
| 6,766,641 | B1 | 7/2004 | Surnilla et al. | |
| 6,805,849 | B1 | 10/2004 | Andreasson et al. | |
| 6,813,882 | B2 | 11/2004 | Hepburn et al. | |
| 6,862,881 | B1 | 3/2005 | Klingbeil et al. | |
| 6,863,874 | B1 | 3/2005 | Twigg | |
| 6,916,450 | B2 | 7/2005 | Akama et al. | |
| 6,973,776 | B2 | 12/2005 | van Nieuwstadt et al. | |
| 6,983,589 | B2 | 1/2006 | Lewis, Jr. et al. | |
| 6,990,800 | B2 | 1/2006 | van Nieuwstadt et al. | |
| 7,000,384 | B2 | 2/2006 | Kagenishi | |
| 7,007,462 | B2 | 3/2006 | Kitahara | |
| 7,021,047 | B2 | 4/2006 | Hilden et al. | |
| 7,055,314 | B2 | 6/2006 | Treiber | |
| 7,078,004 | B2 | 7/2006 | Voss et al. | |
| 7,082,753 | B2 | 8/2006 | Dalla Betta et al. | |
| 7,111,453 | B2 | 9/2006 | Chandler et al. | |
| 7,128,772 | B2 | 10/2006 | Brück | |
| 7,159,391 | B2 * | 1/2007 | Kogo et al. | 60/297 |
| 7,347,043 | B2 * | 3/2008 | Tahara et al. | 60/297 |
| 7,484,359 | B2 * | 2/2009 | Yokoi et al. | 60/286 |
| 2002/0170433 | A1 | 11/2002 | Pfeifer et al. | |
| 2004/0013579 | A1 | 1/2004 | Schaller | |
| 2005/0132674 | A1 | 6/2005 | Toyoda et al. | |
| 2005/0198942 | A1 | 9/2005 | van Nieuwstadt et al. | |
| 2005/0232830 | A1 | 10/2005 | Bruck | |
| 2006/0080953 | A1 | 4/2006 | Maus et al. | |
| 2006/0130464 | A1 | 6/2006 | Sun et al. | |
| 2006/0185352 | A1 | 8/2006 | Twigg | |
| 2006/0272317 | A1 | 12/2006 | Brown et al. | |
| 2007/0012031 | A1 | 1/2007 | Tanimura et al. | |

FOREIGN PATENT DOCUMENTS

| | | | |
|---|---|---|---|
| WO | WO 2004/094045 | A1 | 11/2004 |
| WO | WO 2005/005797 | A2 | 1/2005 |

OTHER PUBLICATIONS

"Proposed Amendments to the Verification Procedure for In-Use Strategies to Control Emissions from Diesel Engines," *California Environmental Protection Agency, Air Resources Board*, pp. 1-29 (Oct. 24, 2003).

U.S. Non-Final Office Action cited in parent U.S. Appl. No. 11/284,143 mailed Dec. 13, 2006.

Amendment filed Apr. 27, 2007 in parent U.S. Appl. No. 11/284,143.

U.S. Final Office Action cited in parent U.S. Appl. No. 11/284,143 mailed Jul. 27, 2007.

Amendment Under 37 CFR § 1.116 filed Sep. 27, 2007 in parent U.S. Appl. No. 11/284,143.

U.S. Non-Final Office Action cited in parent U.S. Appl. No. 11/284,143 mailed Mar. 24, 2008.

Amendment filed Jul. 24, 2008 in parent U.S. Appl. No. 11/284,143.

U.S. Final Office Action cited in U.S. Appl. No. 11/284,143 mailed Nov. 12, 2008.

* cited by examiner

METHOD FOR REGENERATING A DIESEL PARTICULATE FILTER

CROSS REFERENCE TO RELATED APPLICATION

This application is a continuation of U.S. patent application Ser. No. 11/284,143, filed Nov. 21, 2005, which claims the benefit of U.S. Provisional Patent Application Ser. No. 60/674,943, filed Apr. 26, 2005, which applications are hereby incorporated by reference in their entirety.

TECHNICAL FIELD

The present disclosure relates generally to diesel engine exhaust systems. More particularly, the present disclosure relates to systems and methods for controlling diesel engine exhaust emissions.

BACKGROUND

Vehicles equipped with diesel engines may include exhaust systems that have diesel particulate filters for removing particulate matter from the exhaust stream. With use of the diesel particulate filters, soot or other carbon-based particulate matter may accumulate on the filters. As particulate matter accumulates on the diesel particulate filters, the restriction of the filters increases, causing the buildup of undesirable back pressure in the exhaust systems. High back pressures decrease engine efficiency and reduce engine performance. Therefore, to prevent diesel particulate filters from becoming excessively loaded, diesel particulate filters should be regularly regenerated by burning off (i.e., oxidizing) the particulates that accumulate on the filters. Under most diesel engine operating conditions, however, the engine exhaust temperature is too low to cause the diesel particulate filter to completely self-regenerate. Thus, it is necessary to provide a means for initiating regeneration of the diesel particulate filter.

There are a number of methods for regenerating diesel particulate filters known to those skilled in the art. One known method is to operate the engine fuel injection apparatus so as to inject a quantity of fuel late in the combustion stroke of the engine piston, causing the fuel to burn and raise the exhaust temperature sufficiently to initiate regeneration without substantially increasing the engine output torque. Alternatively, a diesel particulate filter may be heated by an electrical heating element to a temperature sufficient to initiate regeneration. Although these systems are generally effective for initiating regeneration of a diesel particulate filter, each has certain drawbacks in application.

Another method for regenerating a diesel particulate filter involves positioning a fuel injector and an oxidation catalyst upstream of a diesel particulate filter. To initiate regeneration, the fuel injector injects hydrocarbon fuel into the exhaust stream, which is oxidized in the oxidation catalyst to raise the temperature of the exhaust stream sufficiently to initiate regeneration of the diesel particulate filter. An example of such a system is disclosed in U.S. patent application Ser. No. 11/016,345, filed Dec. 16, 2004, which is herein incorporated by reference in its entirety.

Diesel exhaust contains nitrogen oxides ($NO_x$), which consist primarily of nitric oxide (NO) and nitrogen dioxide ($NO_2$). Typically, the $NO_2$ in the exhaust stream is a relatively small percentage of total $NO_x$, such as in the range of 5 to 20 percent but usually in the range of 5 to 10 percent. Although nitrogen oxides have been a regulated constituent of diesel exhaust for some time, recent developments have suggested that emissions of $NO_2$ should be regulated separately from overall $NO_x$ emissions for environmental and health reasons. Therefore, it is desired that a diesel exhaust treatment system does not cause excessive increases in the amount of $NO_2$ within the exhaust stream. One regulation proposed in California requires that the ratio of $NO_2$ to $NO_x$ in the exhaust gas downstream from an exhaust treatment system be no more than 20 percent greater than the ratio of $NO_2$ to $NO_x$ in the exhaust gas upstream from the exhaust treatment system. In other words, if the engine-out $NO_x$ mass flow rate is $(NO_x)_{eng}$, the engine-out $NO_2$ mass flow rate is $(NO_2)_{eng}$, and the exhaust-treatment-system-out $NO_2$ mass flow rate is $(NO_2)_{sys}$, then the ratio $$\frac{(NO2)sys - (NO2)eng}{(NOx)eng}$$

must be less than 0.20.

An exhaust treatment system that includes a diesel oxidation catalyst will typically oxidize some of the NO present in the exhaust to form $NO_2$. Moreover, because the exhaust typically flows through the oxidation catalyst at all times, and not only when the diesel particulate filter is being regenerated, the oxidation catalyst will typically cause a significant overall increase in the amount of $NO_2$ emissions. Although total $NO_x$ emissions will generally remain the same, this increase in $NO_2$ may be problematic under proposed diesel exhaust emissions regulations. Therefore, it is desired to create a diesel exhaust treatment system that provides for the regeneration of a diesel particulate filter without excessively increasing $NO_2$ emissions.

SUMMARY

The present disclosure relates to a method for regenerating a diesel emissions control device without excessively increasing $NO_2$ emissions. The system includes a fuel delivery device, an oxidation catalyst, and a diesel particulate filter. During a first operational mode, the fuel injection device injects fuel at a relatively smaller rate into the exhaust stream. The injected fuel enters the oxidation catalyst and favorably occupies catalytic reaction sites therein to reduce NO occupancy of the same sites and minimize the amount of NO that is oxidized to $NO_2$.

At a determined time, such as when the exhaust backpressure becomes excessive or at predetermined time intervals, a second regeneration mode is initiated where fuel is injected at a relatively larger rate into the exhaust stream, where it oxidizes within the diesel oxidation catalyst and raises the exhaust temperature sufficiently to combust substantially all of the soot trapped on the diesel particulate filter. The system therefore enables regeneration of the diesel particulate filter without substantially increasing $NO_2$ emissions.

DETAILED DESCRIPTION

Figure 1:
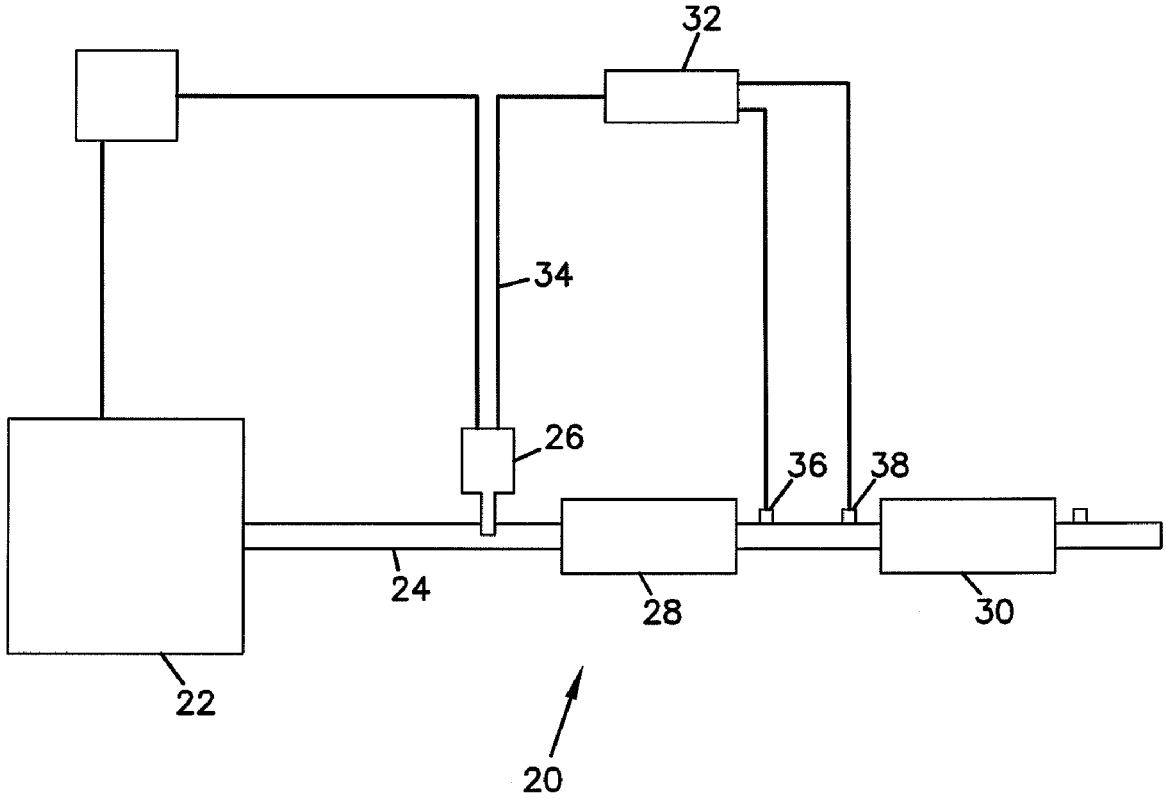
FIG. 1 schematically illustrates an exhaust system having features that are examples of inventive aspects in accordance with the principles of the present disclosure.

The present disclosure relates to a method for regenerating a diesel emissions control device, such as a diesel particulate filter. FIG. 1 illustrates an exhaust system 20 that is in accordance with the inventive aspects of the present disclosure. The system includes an engine 22 (e.g., a diesel engine) and an exhaust conduit 24 for conveying exhaust gas away from the engine 22. A fuel injection device 26 is positioned within exhaust conduit 24 and is adapted to inject fuel into the exhaust stream. An oxidation catalyst 28 is positioned downstream in the direction of exhaust flow from the fuel injection device 26. Downstream from the oxidation catalyst 28 is a diesel particulate filter 30. It will be appreciated that the oxidation catalyst 28 and the diesel particulate filter 30 function to treat the exhaust gas that passes through the conduit 24.

The system further includes controller 32 that functions to control the rate that fuel is dispensed by the fuel supply device 26 into the exhaust conduit 24. The controller 32 interfaces with a number of sensing devices or other data inputs that provide data representative of the exhaust gas traveling through the conduit 24. This data may include the temperature, pressure, and mass flow of the exhaust gas. The controller 32 can use this data to determine the rate that fuel should be dispensed into the exhaust gas stream. Controller 32 provides output control signals to fuel injection device 26 via control line 34.

The oxidation catalyst 28 can have a variety of known configurations. Exemplary configurations include substrates defining channels that extend completely therethrough. Exemplary oxidation catalyst configurations having both corrugated metal and ceramic substrates are described in U.S. Pat. No. 5,355,973, that is hereby incorporated by reference in its entirety. The substrates preferably include a catalyst. For example, the substrate can be made of a catalyst, impregnated with a catalyst or coated with a catalyst. Exemplary catalysts include precious metals such as platinum, palladium and rhodium, and other types of components such as base metals or zeolites.

In one non-limiting embodiment, the oxidation catalyst 28 can have a cell density of at least 200 cells per square inch. A preferred catalyst for the oxidation catalyst 28 is platinum with a loading level greater than 30 grams/cubic foot of substrate. In other embodiments the precious metal loading level is in the range of 30-100 grams/cubic foot of substrate. In certain embodiments, the oxidation catalyst 28 can be sized such that in use, the oxidation catalyst 28 has a space velocity (volumetric flow rate through the oxidation catalyst/volume of the oxidation catalyst) less than 450,000/hour or in the range of 10,000-450,000/hour.

The diesel particulate filter 30 can have a variety of known configurations. An exemplary configuration includes a monolith ceramic substrate having a "honey-comb" configuration of plugged passages as described in U.S. Pat. No. 4,851,015 that is hereby incorporated by reference in its entirety. Wire mesh configurations can also be used. In certain embodiments, the substrate can include a catalyst. Exemplary catalysts include precious metals such as platinum, palladium and rhodium, and other types of components such as base metals or rare earth metal oxides.

The diesel particulate filter 30 preferably has a particulate mass reduction efficiency greater than 75%. More preferably, the diesel particulate filter 30 has a particulate mass reduction efficiency greater than 85%. Most preferably, the diesel particulate filter 30 has a particulate mass reduction efficiency equal to or greater than 90%. For purposes of this specification, the particulate mass reduction efficiency is determined by subtracting the particulate mass that enters the diesel particulate filter from the particulate mass that exits the diesel particulate filter, and by dividing the difference by the particulate mass that enters the diesel particulate filter.

The controller 32 is used to determine when the diesel particulate filter 30 is in need of regeneration. Any number of strategies can be used for determining when the diesel particulate filter 30 should be regenerated. For example, the controller 32 can initiate regeneration of the diesel particulate filter 30 when a pressure sensor 36 indicates that the back pressure in the exhaust conduit 24 exceeds a predetermined level. The controller 32 can also initiate regeneration of the diesel particulate filter 30 at predetermined time intervals. The controller 32 can also be programmed to delay regeneration if conditions of the exhaust system are not suitable for regeneration (e.g., if the exhaust flow rate or exhaust temperature is not suitable for controlled regeneration). For such an embodiment, the controller 32 can be programmed to monitor the operating conditions of the exhaust system and to initiate regeneration only when predetermined conditions suitable for regeneration have been satisfied.

An example of a control system is disclosed in PCT application PCT US04/18536, filed Jun. 10, 2004, entitled Method of Dispensing Fuel into Transient Flow of an Exhaust System, that is hereby incorporated by reference in its entirety.

Figure 2:
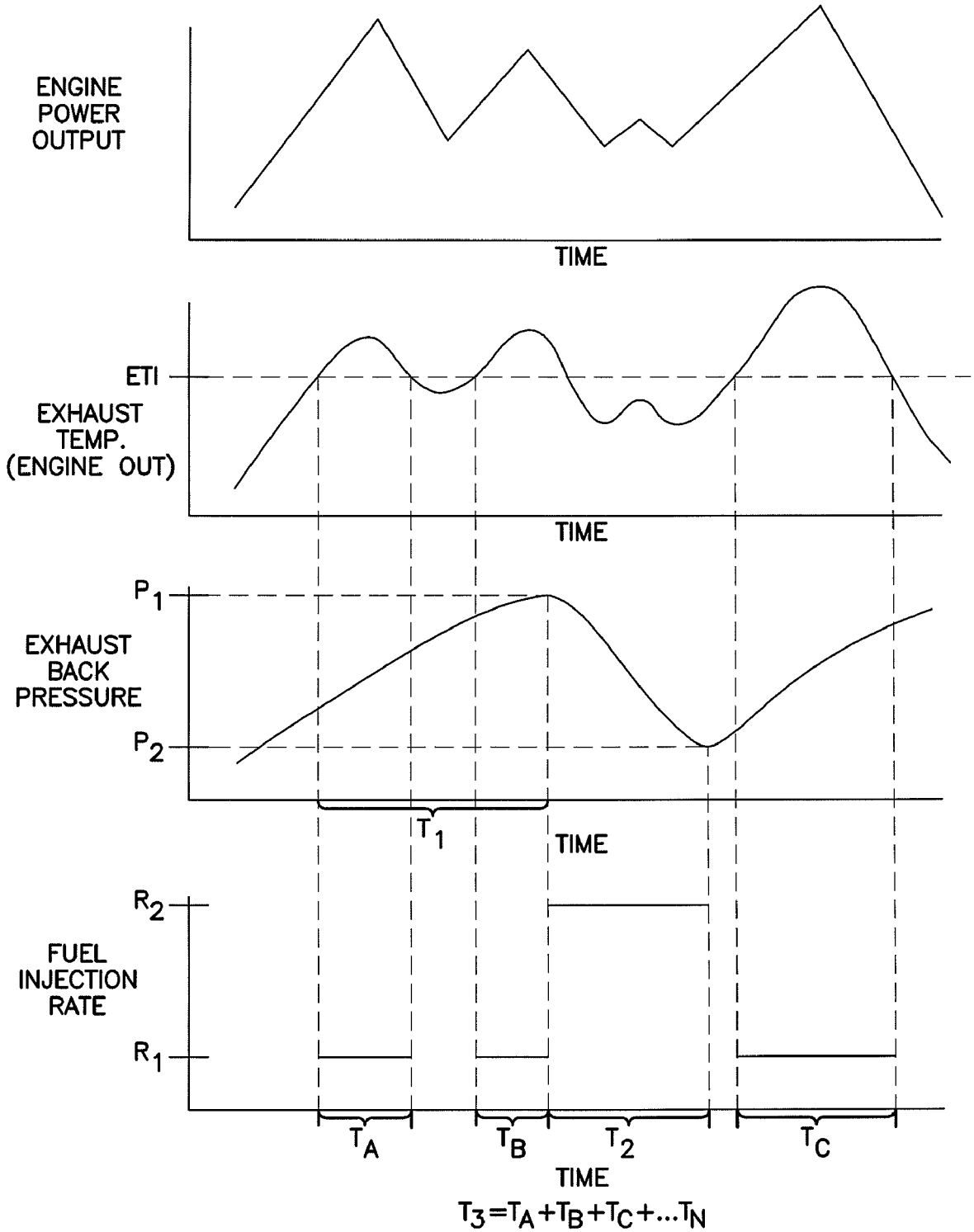
FIG. 2 graphically illustrates the relationship between time and the engine power output, the exhaust temperature, the exhaust backpressure, and the fuel injection rate, in accordance with the principles of the present disclosure.

In operation, the controller 32 may determine the correct time for regeneration by receiving input on the exhaust conduit backpressure from pressure sensor 36 and temperature sensor 38. Referring now to FIG. 2, the backpressure will generally increase steadily as the engine is operated and particulate matter is accumulated on the diesel particulate filter 30. During the time period labeled $T_1$ on FIG. 2, the back pressure is less than the predetermined regeneration pressure labeled $P_1$, indicating that the diesel particulate filter 30 is not in need of regeneration. A preferred value for $P_1$ is 20 kilopascals. Therefore, during time $T_1$, at times when the exhaust temperature is above a predetermined value $ET_1$ the controller 32 operates the fuel injection device 26 so as to inject fuel at a relatively smaller rate, labeled as $R_1$ on FIG. 2. $ET_1$ is generally in the range of 180 degrees C. to 230 degrees C., and is preferably about 230 degrees C. Fuel injection is generally not required at temperatures below $ET_1$ because the $NO_x$ content in the exhaust gas is sufficiently low that the amount of $NO_2$ produced in the oxidation catalyst is relatively small. The time during which fuel is injected at rate $R_1$ is denoted on FIG. 2 as $T_A$, $T_B$, etc.

The rate $R_1$ is calculated based on a predicted mass flow rate of engine output $NO_x$ emissions (in milli-moles per second). This calculation is based on the engine power output, the air intake manifold pressure, the oxygen content in the exhaust stream, and the exhaust temperature at the outlet of the turbocharger. The mechanics of this calculation are disclosed in previously referenced and incorporated U.S. patent application Ser. No. 11/016,345, filed Dec. 16, 2004. The flow rate $R_1$ is then calculated by multiplying the predicted $NO_x$ mass flow rate by a constant F. The constant F is calculated by multiplying the $C_1$-based average molecular weight of the hydrocarbon fuel (milli-grams/milli-mole) by a factor that is in the range of 1 to 5, and preferably is in the range of 1 to 3. For example, a typical $C_1$ value for diesel fuel is $C_1H_{1.93}$. The actual number within this range is determined based on the catalytic surface area within the oxidation catalyst, the catalyst composition, and the required $NO_2$ emission level. The rate $R_1$ is not a fixed value but varies continuously according to the engine operating conditions. It is desired that rate $R_1$ be as low as possible while maintaining the required $NO_2$ emission level in order to minimize fuel consumption.

At some time, the back pressure within the exhaust conduit 24 will reach a predetermined level $P_1$ or a certain time interval will be reached. At this time, the controller 32 will operate the fuel injection device 26 so as to inject fuel at a relatively larger rate, labeled as $R_2$ on FIG. 2. To promote a controlled and efficient regeneration of the diesel particulate filter 30, $R_2$ is selected to cause the temperature of the exhaust gas exiting the oxidation catalyst 28 to have a target temperature in the range of 500 to 700 degrees C. Preferably, the exhaust temperature is in the range of 550 to 650 degrees C., and most preferably the temperature of the gas exiting the oxidation catalyst is about 600 degrees C. Thus, the rate $R_2$ that fuel is dispensed upstream of the oxidation catalyst 28 is preferably selected so that upon oxidation of the fuel within the oxidation catalyst 28, the exhaust gas exiting the oxidation catalyst 28 is within the target temperature range. The value of $R_2$ required to achieve the target temperature range will depend on a number of variables, including the temperature of the exhaust exiting the engine and the mass flow rate of the exhaust.

The controller 32 will continue to operate the fuel injection device 26 at rate $R_2$ for time $T_2$, until the exhaust backpressure reaches the level labeled as $P_2$ in FIG. 2. At this point, the controller 32 will revert to the smaller fuel injection rate $R_1$, so long as the exhaust temperature remains above temperature $ET_1$. The total time that the system operates at fuel injection rate $R_1$ is labeled $T_3$, defined as the sum of $T_A+T_B+T_C+\ldots T_n$. A typical value for $T_3$ is 50 to 95 percent of engine operating time and a typical value for $T_2$ is 2 to 20 minutes. A typical value for $T_3+T_2$ may range for 50 percent of the engine operating time to over 95 percent of the engine operating time. In accordance with the above-specified example percentage for $T_3$, for a 24 hour engine operating period, $T_3$ may be 12 to 22.8 hours. The sum of $T_2$ plus $T_3$ does not necessarily equal 100 percent of engine operating time because there are periods of time where the exhaust temperature is below the target value so no injection is required.

The fuel dispensed into the exhaust conduit 24 by the fuel supply device 26 is oxidized within oxidation catalyst 28. During time $T_3$, the injection of fuel at rate $R_1$ raises the temperature of the exhaust, but does not raise the exhaust temperature to the level required to initiate full regeneration of the diesel particulate filter 30. For example, the injection of fuel at rate $R_1$ may raise the temperature of the exhaust by 100 degrees Centigrade. Instead of causing regeneration of the diesel particulate filter 30, the fuel is dispensed into the exhaust stream and favorably occupies catalytic reaction sites within the oxidation catalyst 28 in order to reduce the oxidation of NO to $NO_2$. Because these reaction sites are favorably occupied, in part, by the injected fuel molecules, fewer sites are available to oxidize NO to $NO_2$ and consequently less $NO_2$ is produced by the oxidation catalyst 28.

During time $T_2$, fuel is injected at rate $R_2$ to raise the temperature of the exhaust gas exiting the oxidation catalyst 28 to a temperature above the combustion temperature of the particulate matter accumulated on the diesel particulate filter 30. In this manner, by oxidizing fuel in the oxidation catalyst 28, sufficient heat is generated to cause regeneration of the diesel particulate filter 30. Preferably, the rate that fuel is dispensed into the exhaust stream is also controlled to prevent temperatures from exceeding levels which may be detrimental to the diesel particulate filter 30. For example, temperatures above 800 degrees Centigrade may be detrimental. Preferably, exhaust temperature sensor 38 is positioned downstream of the oxidation catalyst 28 and provides input to controller 32. If controller 32 senses that the exhaust temperature is excessive, it can reduce the amount of fuel injected by fuel injection device 26.

In one preferred embodiment, time $T_3$ constitutes a majority of the operating time and time $T_2$ constitutes a minority of operating time. More preferably, time $T_3$ constitutes approximately 50 to 95 percent of operating time and time $T_2$ constitutes approximately 0.001 to 5 percent of the operating time.

It will be appreciated that the specific dimensions disclosed herein are examples applicable for certain embodiments in accordance with the principles of the disclosure, but that other embodiments in accordance with this disclosure may or may not include such dimensions.

What is claimed is:

1. A method for injecting fuel into an exhaust system of a diesel engine, the exhaust system including a catalytic converter including a catalyst that promotes oxidation at the catalytic converter, the exhaust system also including a diesel particulate filter positioned downstream from the catalytic converter, the method comprising:

injecting fuel at a first fuel injection rate a majority of the engine operational time to limit the oxidation of NO to $NO_2$ at the catalytic converter, the fuel being injected into the exhaust system from an injection location located upstream from the catalytic converter and downstream from the diesel engine; and injecting fuel from the injection location at a second fuel injection rate a minority of the engine operational time, the second fuel injection rate being higher than the first fuel injection rate, wherein the fuel injected at the second fuel injection rate is combusted at the catalytic converter to provide sufficient heat to cause regeneration of the diesel particulate filter.

2. The method of claim 1, wherein the injection of fuel at the first fuel injection rate comprises 50 to 95 percent of the engine operational time and the injection of fuel at the second fuel injection rate comprises 0.001 to 5 percent of the engine operational time.

3. The method of claim 1, wherein the first fuel injection rate is selected so that the ratio of $NO_2$ to $NO_x$ in the exhaust gas emitted to the atmosphere is no more than 20 percent greater than the ratio of $NO_2$ to $NO_x$ emitted from the engine.

4. A method for injecting fuel into an exhaust system of a diesel engine, the exhaust system including a catalytic converter including a catalyst that promotes oxidation at the catalytic converter, the exhaust system also including a diesel particulate filter positioned downstream from the catalytic converter, the method comprising:

determining whether the diesel particulate filter requires regeneration;

injecting fuel at a first fuel injection rate when the diesel particulate filter does not require regeneration, said first fuel injection rate being insufficient to regenerate the diesel particulate filter, the fuel injected at the first injection rate selected to limit the oxidation of NO to $NO_2$ at the catalytic converter by providing sufficient fuel to favorably occupying catalytic reaction sites at the catalytic converter to reduce NO occupancy of the catalytic reaction sites and thereby limit the NO that is oxidized to $NO_2$, and the diesel fuel being injected into the exhaust system from an injection location located upstream from the catalytic converter and downstream from the diesel engine; and injecting fuel from the injection location at a second fuel injection rate when the diesel particulate filter requires regeneration, said second fuel injection rate being sufficient to regenerate the diesel particulate filter through heat generated by combustion of the diesel fuel at the catalytic converter.

5. The method of claim 4, wherein the first fuel injection rate is determined from a pressure measured in an air intake manifold, an oxygen content measured in the exhaust stream, a temperature measured in the exhaust stream at the turbocharger outlet, and the engine power output.

6. A method for limiting $NO_2$ emissions in an exhaust system for conveying an exhaust stream from an engine, the system including a substrate positioned within the exhaust stream, the system also including a catalyst that promotes oxidation at the substrate, the method comprising:

injecting a hydrocarbon into the exhaust stream at a location between the engine and the substrate, the injection of the hydrocarbon taking place for a majority of an operating time of the engine, wherein the hydrocarbon is injected at a rate selected to limit NO from being oxidized to $NO_2$ at the substrate such that the ratio of $NO_2$ to $NO_x$ in the exhaust stream emitted to the atmosphere is no more than 20 percent greater than the ratio of $NO_2$ to $NO_x$ emitted from the engine, and wherein the total $NO_x$ in the exhaust stream remains generally the same when the exhaust stream passes through the substrate.

7. The method of claim 6, wherein the substrate includes corrugated metal.

8. The method of claim 6, wherein the substrate includes ceramic.

9. The method of claim 6, wherein the fuel is injected at a rate dependent upon a mass flow rate of $NO_2$ in the exhaust stream.

10. The method of claim 9, wherein the mass flow rate of $NO_2$ is a predicted mass flow rate.

11. The method of claim 6, wherein the fuel is injected whenever a temperature of the exhaust stream is sufficient to support the catalyzed production of $NO_2$.

12. The method of claim 11, wherein the temperature is greater than 180 degrees C.

13. The method of claim 6, wherein the injection of fuel does not cause the substrate to regenerate.

14. The method of claim 6, wherein the injection of fuel does not cause the substrate to exceed a temperature of 500 degrees C.

15. The method of claim 6, wherein an operating time of the engine is 24 hours, and wherein the injection of fuel takes place for at least 12 of the 24 hours.

16. The method of claim 6, wherein the substrate is a catalytic converter.

17. The method of claim 6, wherein the exhaust system includes a diesel particulate filter positioned downstream from the substrate.

18. The method of claim 6, wherein the hydrocarbon includes diesel fuel.

19. The method of claim 6, wherein without the hydrocarbon injection the ratio of $NO_2$ to $NO_x$ in the exhaust gas emitted to the atmosphere would be more than 20 percent greater than the ratio of $NO_2$ to $NO_x$ emitted from the engine.

20. The method of claim 4, wherein the first fuel injection rate is selected so that the ratio of $NO_2$ to $NO_x$ in the exhaust gas emitted to the atmosphere is no more than 20 percent greater than the ratio of $NO_2$ to $NO_x$ emitted from the engine.

21. A method for complying with an $NO_2$ emissions limit for an exhaust stream generated by a diesel engine and treated by an exhaust system, the $NO_2$ emissions limit requiring the ratio of $NO_2$ to $NO_x$ in the exhaust stream emitted to the atmosphere from the exhaust system to be no more than 20 percent greater than the ratio of $NO_2$ to $NO_x$ emitted from the engine prior to treatment, the exhaust system including a substrate having a catalyst adapted to promote an oxidation reaction at the substrate, the method comprising:

injecting a hydrocarbon into the exhaust stream at a rate, frequency and duration adapted to limit NO from being oxidized to $NO_2$ at the substrate such that the diesel engine and the exhaust system comply with the $NO_2$ emissions limit requiring the ratio of $NO_2$ to $NO_x$ in the exhaust stream emitted to the atmosphere from the exhaust system to be no more than 20 percent greater than the ratio of $NO_2$ to $NO_x$ emitted from the engine prior to treatment, the hydrocarbon being injected as part of an $NO_2$ control strategy that relies on limiting NO from being oxidized to $NO_2$ by occupying catalytic reaction sites at the substrate with the hydrocarbon to reduce NO occupancy of the catalytic reaction sites, wherein the total $NO_x$ in the exhaust stream remains generally the same when the exhaust stream passes through the substrate.

22. The method of claim 21, wherein the $NO_2$ control strategy does not include the use of a lean NOx catalyst.

* * * * *